United States Patent [19]

Nitschmann

[11] Patent Number: 4,911,050

[45] Date of Patent: Mar. 27, 1990

[54] SAW CHAIN

[75] Inventor: Karl Nitschmann, Schorndorf, Fed. Rep. of Germany

[73] Assignee: Andreas Stihl, Waiblingen, Fed. Rep. of Germany

[21] Appl. No.: 231,889

[22] Filed: Aug. 12, 1988

Related U.S. Application Data

[63] Continuation-in-part of Ser. No. 922,351, Oct. 28, 1986.

[30] Foreign Application Priority Data

Nov. 6, 1985 [DE] Fed. Rep. of Germany ..... 3539334

[51] Int. Cl.[4] ..... B27B 33/14

[52] U.S. Cl. ..... 83/834

[58] Field of Search ..... 83/834, 833, 832

[56] References Cited

U.S. PATENT DOCUMENTS

| | | | |
|---|---|---|---|
| 2,774,396 | 12/1956 | Gommel | 83/834 |
| 2,947,331 | 8/1960 | Irgens . | |
| 3,189,064 | 6/1965 | Frederickson . | |
| 3,469,610 | 9/1969 | Silvon . | |
| 3,548,897 | 12/1970 | Ekrud . | |
| 4,348,927 | 9/1982 | Olmr . | |
| 4,353,277 | 10/1982 | Silvon . | |
| 4,562,762 | 1/1986 | Dubler . | |

FOREIGN PATENT DOCUMENTS

| | | |
|---|---|---|
| 20418 | 12/1960 | Fed. Rep. of Germany . |
| 2940406 | 4/1981 | Fed. Rep. of Germany . |

*Primary Examiner*—Frank T. Yost
*Assistant Examiner*—Scott A. Smith
*Attorney, Agent, or Firm*—Walter Ottesen

[57] ABSTRACT

The invention is directed to a saw chain for a motor-driven saw such as a handheld, portable motor-driven chain saw. The motor-driven saw has a guide bar defining a track for accommodating and guiding the saw chain in a predetermined direction of movement. The saw chain includes a plurality of cutting links, a plurality of connecting links and a plurality of driving links, the links being pivotally interconnected by rivets or the like to define the saw chain. Each of the cutting links includes a plate-like body having a base web for defining rearward and forward openings for receiving respective ones of two of the rivets therein. The plate-like body has a rearward portion extending upwardly from the rearward region of the base web to define a cutting tooth. The plate-like body has a forward portion extending upwardly from the forward region of the base web so as to be spaced from the cutting tooth. The forward portion is bent over transversely to the direction of movement at a predetermined distance from the base web to define a depth limiter. The depth limiter has an upwardly directed top surface subdivided into a bearing face directly adjacent to the cutting tooth and an abutment face extending forwardly of the bearing face so as to be inclined downwardly in the direction of movement.

3 Claims, 3 Drawing Sheets

SAW CHAIN

RELATED APPLICATION

This is a continuation-in-part of application serial No. 922,351 now abandoned, filed Oct. 23, 1986 and entitled "Saw Chain".

FIELD OF THE INVENTION

The invention relates to a saw chain for a motor-driven saw such as a portable hand-held motor-driven chain saw. A depth limiter is bent transversely to the direction of chain travel at a distance from the base web of the cutting link and is associated with the cutting tooth of the cutting link.

BACKGROUND OF THE INVENTION

Known motor-driven chain saws of this type have cutting teeth with which a depth limiter is associated in the direction of advancement of the saw chain. The depth limiter may either be integral with the cutting tooth or may be a part separate from the cutting link. The task of the depth limiter is to limit the cutting depth of the cutting tooth, or in other words the chip thickness, in both severing and plunge cutting operations. Under certain working conditions, such as when cutting into soft wood and/or if the operator exerts relatively great force in applying the saw chain against the wood, the depth limiter may not perform its task entirely properly because under certain conditions it is pressed too deeply into the bottom of the kerf. In plunge cutting work, the result may even be the so-called kickback effect, which happens when the cutting tooth cuts too deeply into the wood during the movement of the saw chain over the free end of the guide bar. The depth limiter is then necessarily pulled into the wood also, and sticking there causes a recoil or kickback that presents an immediate danger to the operator. This jamming in the wood occurs particularly if the depth limiter has only a relatively small limiting face in the bottom of the kerf, so that when force is applied, a relatively high surface pressure acts upon this small limiting face.

East German Patent 20418 discloses that the top edge of the depth limiter can be bent transversely to the direction of chain advancement in such a way that the limiting face of the depth limiter in the bottom of the kerf is larger as compared with the width of the base web; as a result, the surface pressure, when the depth limiter penetrates the wood, is kept lower than is the case with conventional depth limiters, which merely have an upper bearing surface of the same width as the base web. In any case, the limiting face of the depth limiter is located parallel to the running surface of the saw chain, the term "'running surface" being understood as the surface traced by the cutting edge during the movement of the saw chain about the periphery of the guide bar.

U.S. Pat. No. 2,947,331discloses a saw chain in which the depth limiter is bent out of the plane of the base web of the cutting link, transversely to the direction of travel, in such a manner that the bent limiting face of the depth limiter is disposed next to the plane of the running surface.

In these known saw chains, it is disadvantageous that the depth limiters that are bent transversely to the direction of travel can be reground only to a limited extent, and in each regrinding operation the entire transverse depth limiter surface must regularly be removed. As a result, the overall cutting link is weakened, and after about half of the available material of the depth limiter has been removed, there is the danger that the cutting link will not operate properly, in particular in the region of the depth limiter, during plunge cutting operations or in other words under high loading.

In a saw chain of a different generic type known from European Patent Application 0054169, a chain connecting link disposed beside the depth limiter is configured as extending upwardly in such a way as to provide a surface that is parallel to the actual depth limiter. In addition to the upwardly extending connecting link, an upwardly extended section is also provided on a so-called center link, thereby providing a further surface parallel to the depth limiter. A significant disadvantage of this embodiment is that the friction surface area of the depth limiter is enlarged considerably, and so a substantially greater advancing force is required during work with the chain saw, because of the greater frictional forces that exist. As a result, there is a substantial reduction in efficiency, and greater forces must be exerted for driving the chain saw and applying feeding or advancing pressure thereto. The expenditure for materials is also considerably greater, and the disposition of the additional limiting faces necessitates additional machining, so that all in all this saw chain is complicated and expensive.

SUMMARY OF THE INVENTION

It is an object of the invention to provide a saw chain of the kind described above which is improved such that a large and yet predominantly low-friction limiting surface of the depth limiter is obtained without cross-sectional weakening when the latter is filed. In addition, the ratio between the cutting tooth and the depth limiter, and the size of the limiting face even when filing, are optimally maintained.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
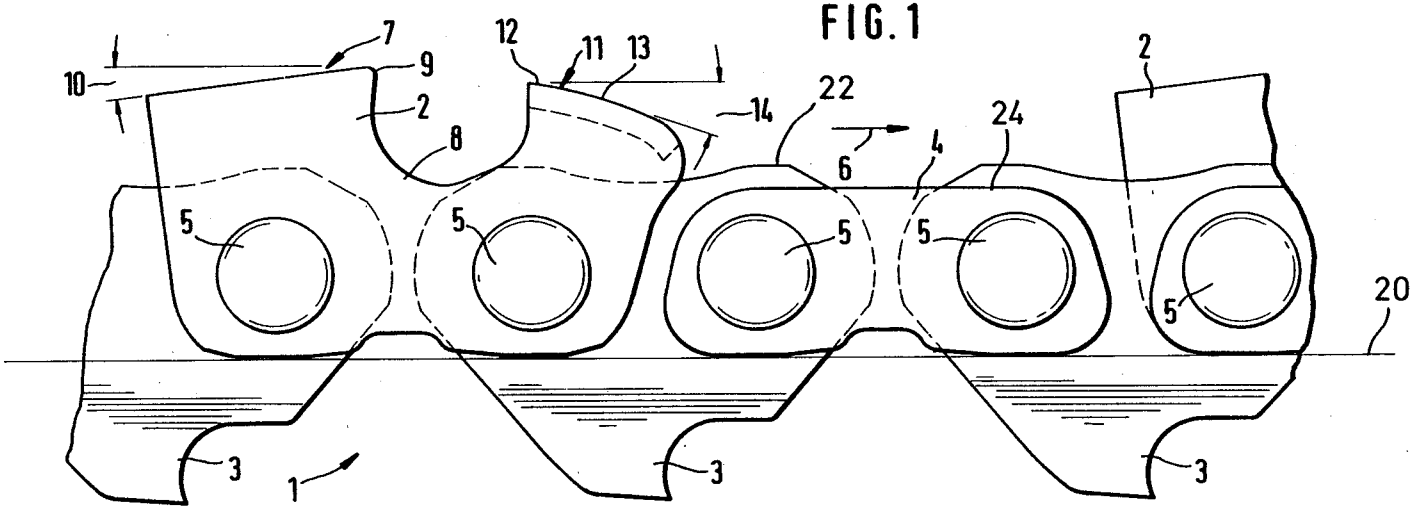
FIG. 1 is a side elevation view of a saw chain according to the invention, enlarged several times.

The saw chain 1 according to the invention has cutting links 2 and drive links 3, which are pivotally connected via connecting links 4 and rivets 5. The cutting links 2 and the connecting links 4 are in the form of so-called side links in the embodiment shown, while the drive links 3 are in the form of so-called center links, each between two of these side links.

The saw chain 1, driven in the direction of chain travel 6, is supported such that it revolves on a guide bar, not shown in detail here, which is mounted on a portable motor-driven tool. The motor drives a sprocket wheel (not shown), the tooth gaps of which are engaged by the drive links 3.

The cutting link 2 has a cutting tooth 7 on the top of its rear portion; the cutting tooth is bent transversely to the plane of the base web 8 and has a cutting edge 9 at the front. The cutting tooth 7 is inclined to the rear, beginning at the cutting edge 9, thereby defining a clearance angle 10.

A depth limiter 11 is formed on the top front portion of the cutting link 2, and like the cutting tooth, it is also bent transversely to the plane of the base web 8. This particularly advantageous depth limiter 11 has two effective work faces: a first bearing face 12, formed on the rear portion of the depth limiter 11 and thus located directly opposite the cutting edge 9 of the cutting tooth 7, and adjoining it toward the front, in the direction of chain travel 6, a second work face in the form of a contact engaging of an abutment face 13 inclined in a somewhat roof-like fashion. The inclination of the abutment face 13 thus extends in precisely the opposite direction from the inclination of the cutting tooth 7; the inclination of the abutment face 13 is preferably so steep that the thereby attained clearance angle 14 of the depth limiter 11 is larger than the clearance angle 10 of the cutting tooth 7. The bearing face 12 of the depth limiter 11 is located in a plane that lies somewhat lower than the plane of the cutting edge 9 but extends parallel thereto.

Suitably, the width of the inclined abutment face 13 of the depth limiter 11 is greater in the direction transverse to the direction of chain travel 6 than the thickness of the base web 8, so that in any case there is a large limiting face for limiting depth at the bottom of the kerf. In all the exemplary embodiments shown, the bearing face 12 of the depth limiter 11 is also wider in the direction transverse to the direction of chain travel 6 than the thickness of the base web 8, thereby providing an additional enlargement of the total limiting face.

In particular applications, however, it may also be desirable to configure the depth limiter, in terms of its total limiting face, such that the width of the inclined abutment face 13 is greater than the width of the bearing face 12, and the width of the bearing face 12 may preferably be approximately equal to the thickness of the base web 8, so that when limiting depth in the kerf, an extremely low-friction work face initially comes into play by means of the relatively narrow bearing face 12, while as the pressure increases, the wider inclined abutment face 13 becomes effective as an additional second work face.

Figure 7:
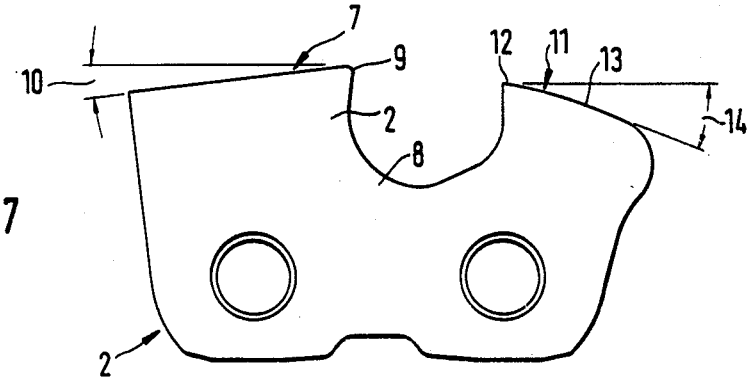
FIG. 7 is a side elevation view of another cutting link according to the invention which is similar to the cutting link of 5; and, FIG. 8 is a plan view of the cutting link of FIG. 7.
Figure 8:
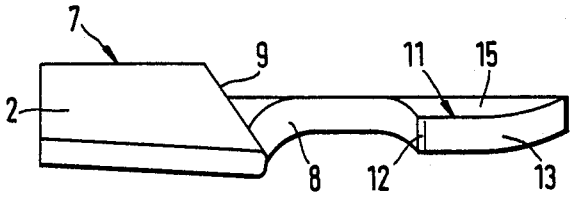

In the embodiment of FIGS. 7 and 8, the bearing face 12 and the abutment face 13 are narrower, in the direction transverse to the plane of the base web 8, than the width of the cutting tooth 7. As FIG. 8 shows, the depth limiter 11 is embodied on a bent portion 15, which is bent not at right angles to the base web 8 but only bent obliquely to the side. Since the bearing face 12 and the inclined abutment face 13 are at right angles to the plane of the cutting link 2, the width of the bearing face 12 and of the abutment face 13 in the direction transverse to the direction of chain travel 6 is greater than the thickness of the material comprising the base web 8.

Figure 2:
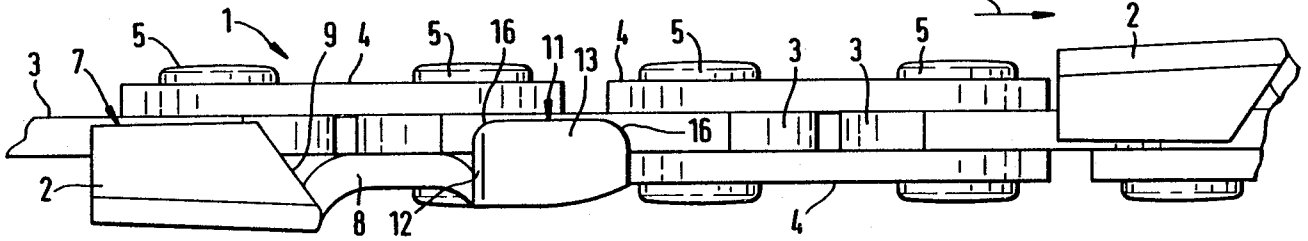
FIG. 2 is a plan view of the saw chain of FIG. 1.
Figure 3:
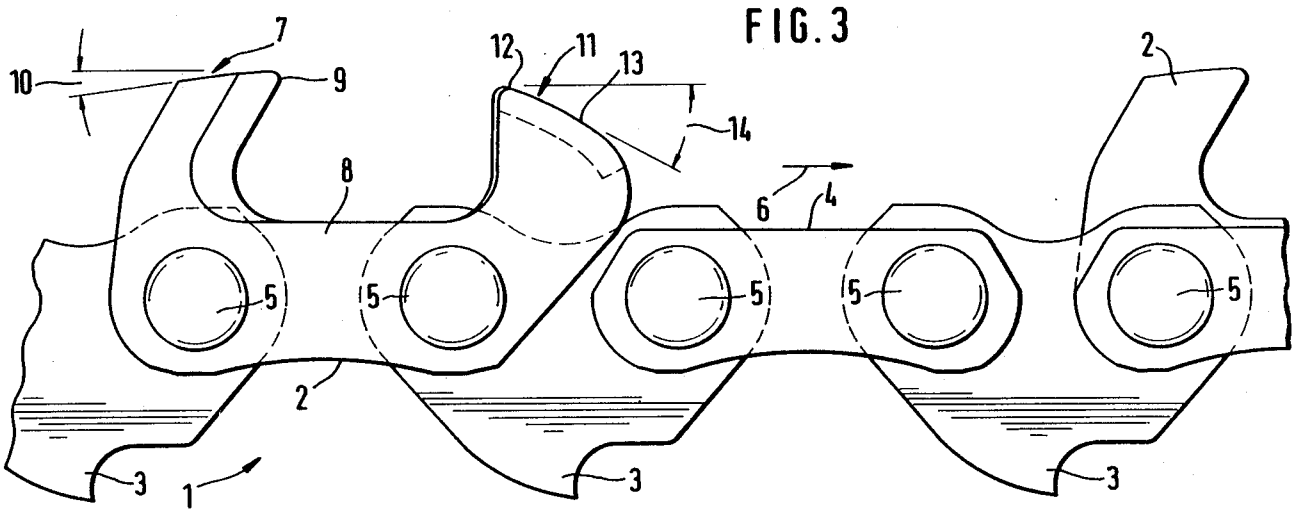
FIG. 3 is a side elevation view of another embodiment of the saw chain according to the invention, enlarged several times.
Figure 4:
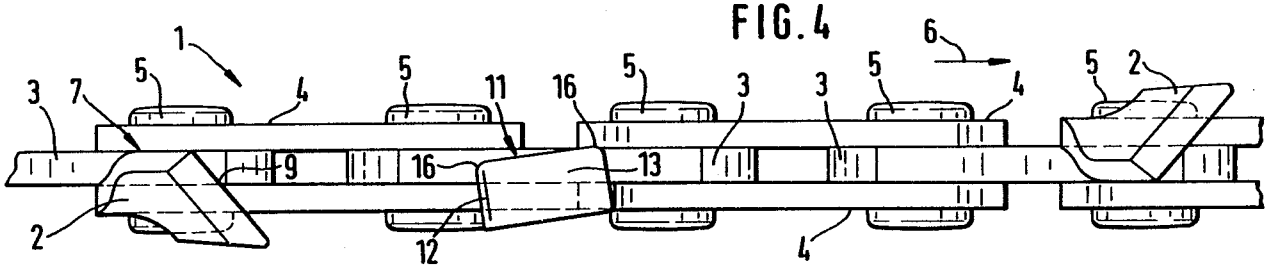
FIG. 4 is a plan view of the saw chain of FIG. 3.
Figure 5:
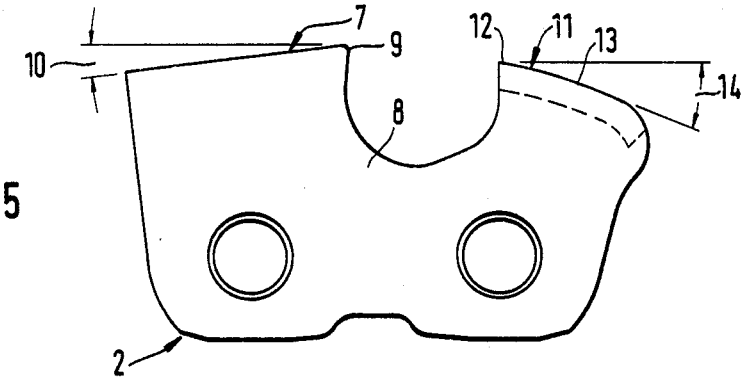
FIG. 5 is a side elevation view of the cutting link of the saw according to FIG. 1.
Figure 6:
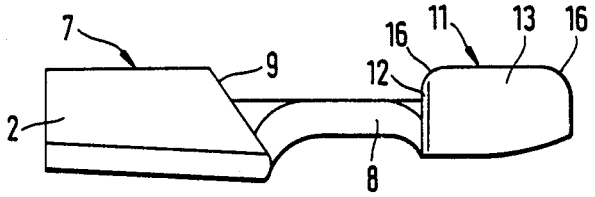
FIG. 6 is a plan view of the cutting link of FIG. 5.

In the embodiment shown in FIGS. 1 and 2 as well as FIGS. 5 and 6, the depth limiter 11 and the cutting tooth 7 are both bent at right angles to the plane of the base web 8, and toward the same side. As also shown in FIGS. 3 and 4, the width of the depth limiter 11 is only somewhat smaller than the width of the cutting tooth 7. The free corner portions of the depth limiter 11 ar not sharp-edged but instead are rounded at 16, which also reduces the frictional resistance at the bottom of the kerf.

In the embodiment of FIGS. 3 and 4, the cutting tooth 7 is not bent at right angles toward the side as in FIG. 2, but rather is narrower and is turned or crossed obliquely to the plane of the base web 8, so that the cutting edge 9 is approximately the same length as the cutting edge 9 in FIG. 2.

In the saw chain 1 according to the invention, as compared with the prior art, the advantage is realized that the entire bent surface of the depth limiter does not rest on the bottom of the kerf, but only the rear face portion, as viewed in the cutting direction of the saw chain 1, or in other words, only the bearing face 12. During refiling, because of the inclination of the oblique depth limiter face, only the uppermost section of the inclined depth limiter 11 is engaged by the sharpening tool and removed at any time, so that the bearing face 12 of the depth limiter 11 facing toward the saw tooth 7 is resharpened whenever the remaining inclined abutment face 13 located at the front in the cutting direction is not engaged during the sharpening process and accordingly does not perform a direct bearing function during the cutting operation.

Referring to FIG. 1, it is noted that the driving links 3 and the connecting links 4 have respective top edges 22 and 24 at an elevation above the track 20 which is less than the elevation of the abutment face 13 thereabove. This permits the abutment face 13 to be pressed progressively against the base of the kerf in the event of a potential kickback situation to thereby prevent a sudden jamming of the cutting tooth in the wood. This is a substantial advantage of the invention because when sawing a relatively soft wood or when the operator exerts an excessive advancing or feed pressure, the depth limiter 11 is pressed with greater intensity against the kerf bottom, more than during normal handling and/or more than with usual wood hardness, so that the abutment face 13 of the depth limiter 11, which abutment face 13 is not intended for normal cutting, comes to rest on the kerf bottom. As a result, a progressive decrease in the surface pressure at high advancing pressure is attained, which largely eliminates the danger of recoiling (the kickback effect) since, because of the progressive penetration of the depth limiter face, a sudden jamming of the depth limier 11 and the saw tooth 7 does not occur.

Thus, the depth limiter 11 of the saw chain 1 according to the invention has two operative faces, namely: first, the bearing face 12, which is substantially parallel to the running direction of the saw chain and is refinished when resharpening is done; and, second, the inclined abutment face 13 on the depth limiter 11 which is defined when the cutting link 2 is manufactured. The abutment face 13 has a predetermined angle of inclination and stands in reserve for the bearing face 12 when resharpening is performed. Furthermore, an during operation of the chain saw, the abutment face 13 brings about the above-described progressive reduction of the surface pressure in the event of unforeseen relatively deep penetration of the depth limiter 11 into the wood.

The configuration of the depth limiter 11 having the two effective faces 12, 13, makes it possible, first, to adapt the depth limiter 11, in terms of its function and mode of operation, to the intended usage of the saw chain 1 or of the hand-held, motor-driven saw, in that the bearing face 12 and the inclined abutment face 13 are adapted to one another in terms of their size in accordance with the given kickback behavior during the sawing process. For example, the depth limiter 11 can be used with a larger bearing face 12 and a lesser inclination of the abutment face 13 whenever a relatively forceful feed advance is tolerated for safety reasons (lower kickback).

The embodiment of the depth limiter 11 can be practically applied to all embodiments of cutting links and saw chains 1, even those in which the cutting link and the depth limiter are automatically sharpened by a sharpener that can be attached to the motor-driven saw.

The depth limiter 11 offers the further advantage that the geometry of the bearing face 12 and of the inclined abutment face 13 of the depth limiter 11 can be adapted precisely to a given geometry of the cutting tooth 7, which is particularly advantageous in the manufacture of planing or chiseling teeth, because with them, the depth limiter 11 can be manufactured using the same process as that for the chiseling or planing teeth, namely swaging or bending.

Refiling of the depth limiter 11 should be done only to such an extent that at the last refiling, an adequate abutment face 13, inclined obliquely toward the front, still remains, so as to maintain safety and not impair the resistance of the saw chain 1 to recoiling. A further advantage of the invention is that in resharpening of the cutting link 2, the spacing between the cutting edge 9 of the saw tooth 7 and the depth limiter 11 corresponding thereto becomes greater, because of the removal of material defining the bearing face 12, which enlarges with each sharpening. Because of the increase of this spacing, the behavior of the cutting link 2 together with the depth limiter 11 during sawing becomes less favorable, in particular with respect to the kickback effect. This is compensated for in optimal fashion by the automatic enlargement of the bearing face 12 during resharpening, so that even after repeated resharpening, a high level of safety from the dreaded kickback of the saw chain or of the motor-driven saw is always provided.

When bearing face 12 is filed during resharpening of the cutting links 2, the cross section of the bent over portion of the depth limiter 11 remains substantially intact because of the downwardly extending abutment face 13. Stated otherwise, only the bearing face 12 facing toward the cutting tooth 7 and extending substantially parallel to the running direction of the saw chain is filed down during the resharpening process which also includes refiling the cutting edge 9. The partition line between the bearing face 12 and the abutment face 13 is perforce moved slightly forward with each resharpening operation; however, because the abutment face 13 is downwardly inclined as shown in FIGS. 1 and 3, it remains effective in imparting strength to the depth limiter 11 and in its function to limit kickback as described above.

For manufacturing reasons, it may be advantageous to bend the depth limiter 11 of the cutting link 2 over in the same direction as the cutting tooth 7.

It is understood that the foregoing description is that of the preferred embodiments of the invention and that various changes and modifications may be made thereto without departing from the spirit and scope of the invention as defined in the appended claims.

What is claimed is:

1. A saw chain for a motor-driven saw such as a handheld, portable motor-driven chain saw having a guide bar defining a track for accommodating and guiding the saw chain in a predetermined direction of movement as the latter cuts a kerf in wood, the saw chain comprising:

at least one cutting link, a plurality of connecting links and a plurality of driving links, the links being pivotally interconnected by rivets or the like to define the saw chain, the cutting link including:

a plate-like body having a base web for defining rearward and forward openings for receiving respective ones of two of said rivets therein;

said plate-like body having a rearward portion extending upwardly from the rearward region of said base web to define a cutting tooth having a cutting edge facing in said direction of movement;

said plate-like body having a forward portion extending upwardly from the forward region of said base web so as to be spaced from said cutting tooth, said forward portion being bent over substantially at right angles to said base web and to said direction of movement at a predetermined distance from said base web to define a depth limiter having a width wider than the thickness of said base web and less than the width of said cutting edge;

said depth limiter having a upwardly directed top surface extending transversely to said base web, said top surface being subdivided into a bearing face having a first length measured in the direction of said movement and being directly adjacent to said cutting tooth and an abutment face having a second length also measured in the direction of said movement and extending forwardly of said bearing face so as to be inclined continuously downwardly with respect to said bearing face in said direction of movement; and, said abutment face having a width adjacent said bearing face which is greater than the width of said bearing face wherein the width of said bearing face is measured rearwardly of a line of intersection between said abutment and bearing faces; and said driving links and said connecting links being the remaining non-cutting links in said saw chain and having respective top edges at an elevation above said track which is less than the elevation of said abutment face thereabove so as to permit said abutting face to be pressed progressively against the base of the kerf in the event of a potential kickback situation of thereby prevent a sudden jamming of said cutting tooth in the wood.

2. The saw chain of claim 1, said cutting tooth having a cutting edge which moves in a cutting plane parallel to the track as the cutting link moves in said direction, said cutting edge being disposed directly adjacent said depth limiter; and, said bearing face defining a plane parallel to and below said cutting plane.

3. The saw chain of claim 2, said cutting tooth having a top surface inclined downwardly from said cutting edge and opposite to said direction of movement so as to define a predetermined first angle with said cutting plane passing through said cutting edge, and said abutment face defining a predetermined second angle with a horizontal plane passing through said bearing face, said second angle being greater than said first angle.

* * * * *

UNITED STATES PATENT AND TRADEMARK OFFICE

CERTIFICATE OF CORRECTION

PATENT NO. : 4,911,050

DATED : March 27, 1990

INVENTOR(S) : Karl Nitschmann

It is certified that error appears in the above-identified patent and that said Letters Patent is hereby corrected as shown below:

On the title page, under "Related U.S. Application Data", delete "Oct. 28, 1986." and substitute -- Oct. 23, 1986. -- therefor.

On the title page, under "FOREIGN PATENT DOCUMENTS", delete "20418 12/1960 Fed. Rep. of Germany." and substitute -- 20418 12/1960 German Democratic Republic. -- therefor.

In column 3, line 20: delete "of" and substitute -- or -- therefor.

In column 4, line 3: delete "ar" and substitute -- are -- therefor.

In column 4, line 61: delete "an" and substitute -- and -- therefor.

In column 6, line 52: delete "of", first occurrence, and substitute -- to -- therefor.

Signed and Sealed this

Second Day of July, 1991

*Attest:*

*Attesting Officer*

HARRY F. MANBECK, JR.

*Commissioner of Patents and Trademarks*